US010557471B2

(12) United States Patent
Stansbury

(10) Patent No.: US 10,557,471 B2
(45) Date of Patent: Feb. 11, 2020

(54) TURBOMOLECULAR VACUUM PUMP FOR IONIZED MATTER AND PLASMA FIELDS

(71) Applicant: L Dean Stansbury, Conifer, CO (US)

(72) Inventor: L Dean Stansbury, Conifer, CO (US)

( * ) Notice: Subject to any disclaimer, the term of this patent is extended or adjusted under 35 U.S.C. 154(b) by 261 days.

(21) Appl. No.: 15/815,337

(22) Filed: Nov. 16, 2017

(65) Prior Publication Data

US 2019/0145418 A1 May 16, 2019

(51) Int. Cl.

| | |
|---|---|
| ***F04D 27/00*** | (2006.01) |
| ***F04D 27/02*** | (2006.01) |
| ***F04D 19/04*** | (2006.01) |
| ***F04D 17/16*** | (2006.01) |
| ***F04D 29/32*** | (2006.01) |
| *F04D 13/02* | (2006.01) |
| *F04D 29/66* | (2006.01) |

(52) U.S. Cl.

CPC ..... *F04D 27/002* (2013.01); *F04D 17/168* (2013.01); *F04D 19/042* (2013.01); *F04D 27/0246* (2013.01); *F04D 29/324* (2013.01); *F04D 13/026* (2013.01); *F04D 29/662* (2013.01)

(58) Field of Classification Search

CPC ..... F04D 19/04; F04D 19/042; F04D 19/044; F04D 19/046; F04D 17/168; F04D 29/3234

See application file for complete search history.

(56) References Cited

U.S. PATENT DOCUMENTS

| | | | | |
|---|---|---|---|---|
| 4,732,529 | A | 3/1988 | Narita et al. | |
| 4,746,265 | A | 5/1988 | Luijten | |
| 4,826,394 | A * | 5/1989 | Lotz | F04D 19/046 415/72 |
| 4,893,985 | A * | 1/1990 | Holss | F04D 19/044 415/90 |
| 5,020,969 | A * | 6/1991 | Mase | F04D 23/008 415/55.1 |
| 5,219,269 | A | 6/1993 | Ikegami et al. | |
| 5,358,373 | A | 10/1994 | Hablanian | |
| 5,536,148 | A * | 7/1996 | Nishiuchi | F04D 17/168 417/203 |
| 6,705,844 | B2 | 3/2004 | Englaender | |
| 7,390,164 | B2 * | 6/2008 | Maejima | F04D 19/04 415/104 |
| 7,645,126 | B2 * | 1/2010 | Sekiguchi | F04D 17/168 416/223 A |

(Continued)

FOREIGN PATENT DOCUMENTS

WO WO-2017121696 A1 * 7/2017 ..... F04D 29/642

*Primary Examiner* — Patrick Hamo

(74) *Attorney, Agent, or Firm* — Marsh Fischmann & Breyfogle LLP

(57) ABSTRACT

A turbomolecular pump is provided. In one arrangement, a stator stack and rotor stack have corresponding conical or frustum shapes that allow for adjusting the clearance between the stator vanes and rotor vanes of the pump to provide adjustable compression ratios and/or to adjust clearances. In another arrangement, the actuator or drive mechanism of the pump is formed from coils attached to the upper stage of rotor vanes which are controlled to interact with a plurality of stationary magnets attached to the housing of the pump to rotate the stator stack. In another arrangement, a control system of the pump utilizes the coils of the rotor drive to dynamically balance the pump during operation.

20 Claims, 12 Drawing Sheets

(56) References Cited

U.S. PATENT DOCUMENTS

| | | | | |
|---|---|---|---|---|
| 8,221,052 | B2 * | 7/2012 | Tsutsui | F04D 29/321<br>415/143 |
| 8,668,436 | B2 | 3/2014 | Oishi | |
| 8,790,071 | B2 | 7/2014 | Oishi | |
| 9,453,510 | B2 * | 9/2016 | Kawanishi | F04D 19/046 |
| 9,453,514 | B2 * | 9/2016 | Watz | F04D 19/04 |
| 2006/0018772 | A1 | 1/2006 | Casaro | |

* cited by examiner

TURBOMOLECULAR VACUUM PUMP FOR IONIZED MATTER AND PLASMA FIELDS

FIELD

The present disclosure relates to turbomolecular pumps. More specifically, the present disclosure is directed to various embodiments of turbomolecular pumps that may be dynamically rebalanced during operation to counter the effects of, for example, condensation of process material on the rotors or stators during a vacuum deposition process.

BACKGROUND

Physical vapor deposition (PVD) is directed to a variety of vacuum deposition methods which can be used to produce thin films and coatings. Such processes typically require the use of hostile gases at low pressures within a vacuum chamber. These processes include, for example, plasma deposition, plasma etching, low pressure chemical vapor deposition and ion implantation.

Historically, many PVD processes utilized oil diffusion high vacuum pumps. However, many industries have moved away from the use of oil diffusion pumps as part of PVD process equipment due to contamination. That is, the operating principle of oil diffusion pumps dictates that the working oil of the pump be directly exposed to the chamber that is evacuated. Oil molecules thus migrate into the process chamber, intermingle with the gases and contaminate the process. For many PVD applications where contamination is a concern (e.g., semi-conductor manufacturing), turbomolecular pumps have become the industry standard, as such pumps typically do not contaminate the local vacuum environment.

Turbomolecular pumps are basically high-speed turbines that operate on kinetic gas principles. That is, turbomolecular pumps work on the principle that gas molecules can be given momentum in a desired direction by repeated collision with a moving solid surface. In a turbomolecular pump, rapidly spinning rotor blades 'hit' gas molecules from the inlet of the pump towards the exhaust in order to create or maintain a vacuum. Most turbomolecular pumps employ multiple stages, each consisting of a set or stack of rotating rotor blades/vanes and stationary stator blades/vanes. Typically, the rotor of a turbomolecular pump rotates on sealed and/or magnetic levitation bearings, which results in little or no contamination. In any arrangement, gas molecules captured by the upper stages of the pump are pushed into the lower stages and successively compressed. As the gas molecules enter through the inlet, the rotor, which has a number of angled vanes, hits the molecules. Thus the mechanical energy of the vanes is transferred to the gas molecules. With this newly acquired momentum, the gas molecules enter into the gas transfer areas in the stator vanes. This leads them to the next stage where they again collide with a rotating rotor vane surface, and this process is continued, finally leading the molecules outwards through the exhaust.

To achieve low vacuum levels, turbomolecular pumps run at high rotational speeds. In order to obtain extremely low pressures down to, for example, 1 micropascal, rotation rates of 20,000 to 90,000 revolutions per minute are often necessary. Such high rotation rates stress the rotor bearings of the pump requiring periodic maintenance and/or replacement of the bearings. Bearing can be further stressed in PVD processes where a deposition process generates metal or chemical vapors that can deposit/condense on the turbo pump rotor blades. Such deposition/condensation can create an unbalanced condition for the turbo pump rotor. Such an unbalanced condition can significantly shorten the life of the bearings thereby requiring early bearing replacement and/or rebalancing of the rotor.

SUMMARY

A turbomolecular pump is provided having a number of novel features that may be utilized alone or in various combinations. In one arrangement, a stator stack and rotor stack have corresponding conical, curved or frustum shapes that allow for adjusting the clearance between the stator vanes and rotor vanes of the pump to provide adjustable compression ratios and/or to adjust clearances. In another arrangement, the actuator or drive mechanism of the pump is formed from coils attached to the blades of upper stage of a rotor stack which are controlled to interact with a plurality of stationary magnets attached to the housing of the pump to rotate the rotor stack. In another arrangement, a control system of the pump utilizes the coils of the rotor drive to dynamically balance the pump during operation.

In one aspect, a turbomolecular pump is provided that allows for adjusting clearances between stator vanes and rotor vanes. Such adjustment may be done prior to pump operation and/or dynamically during pump operation. The pump includes a rotor stack having a plurality of sets of rotor vanes, which extend radially outward from a hub, which rotates about a stationary shaft (e.g., rotor shaft). The rotor stack rotates within a stator stack having a plurality of sets of stator vanes that extend radially inward from an outer stator housing (e.g., toward the hub of the rotor stack). The rotor stack and stator stack are disposed within a pump housing. The rotor stack and stator stack have generally matching curved profiles in cross-section. In one arrangement, the curved profiles are conical profiles. However, the term conical as utilized herein is intended to include variations from a cone. That is, the profiles may be frustum shaped or otherwise curved. In any arrangement, a profile of the rotor stack, as defined by the tips of the different sets of rotor blades, defines a first conical profile. A profile of the stator stack, as defined by root surfaces between different sets of stator blades, defines a second conical profile. One or more adjustable connectors attach the stator stack to the pump housing. Adjustment of the connectors allows for adjusting a vertical position of the stator stack relative to a vertical axis of the pump, where the vertical axis is defined by a central axis of the rotor shaft. In contrast, the position of the rotor stack may remain fixed. This adjustment allows adjusting the axial position of the second conical surface of the stator stack relative to the axial position of the first conical surface defined by the rotor stack. Such adjustment, in combination with the conical profiles of the stator stack and rotor stack, provides adjustment in two dimensions between the stator vanes and the rotor vanes. More specifically, a distance between the tips of the rotor vanes and the root surfaces of the stator housing may be increased or decreased in conjunction with adjusting the distance between the top and or bottom edges of the stator and rotor vanes. This allows for adjusting the compression of the pump and/or adjusting clearance of the vanes to account for condensation buildup.

In another aspect, a turbomolecular pump is provided that utilizes coils attached to rotor vanes as a drive motor for the pump. Stated otherwise, the pump utilizes a rotor drive system. The pump includes a rotor stack having a plurality of sets of rotor vanes, which extend radially outward from a hub, which rotates about a stationary shaft. The rotor stack rotates within a stator stack having a plurality of sets of stator vanes that extend radially inward from an outer stator housing (e.g., toward the hub of the rotor stack). The rotor stack and stator stack are disposed within a pump housing. One set of the blades of the rotor stack includes a plurality of electrical coils attached thereto. These coils interact with a plurality of magnets fixedly attached the pump housing. A control system provides drive signals to each of the plurality of coils such that they are attracted and/or repelled by the magnets to impart rotation to the rotor stack.

In another aspect, a turbomolecular pump having a rotor drive system may be dynamically balanced during operation. The pump includes a rotor stack disposed within a stator stack, which are both disposed within a housing. The rotor stack rotates about a stationary shaft associated with the housing. At least one bearing rotatably couples the rotor stack to the rotor shaft. Each bearing further includes one or more optical strain sensors that generate output signals indicative of strains on or in the bearing. The outputs are provided to a control system that is configured to provide a plurality of individual drive signals to a plurality of coils attached to at least a first set of rotor blades of the rotor stack. More particularly, the control system utilizes the outputs from the optical sensors to determine an imbalance in the rotor stack. Upon determining an imbalance in the rotor stack, individual drive signals are provided to each of the individual coils. The individual drive signals may be adjusted to counteract the imbalance. In one arrangement, the outputs of the optical sensors are provided to the control system via optical filaments. Use of optical sensors and filaments allows utilizing the pump in electrically noisy environments. In a further arrangement, the drive signals are provided to each individual coil utilizing optical signals, which again allow for use in electrically noisy environments. In one arrangement, optical drive signals are provided to optical actuators which are disposed proximate to insulated gate bipolar transistors (IGBTs). The IGBTs are connected to the rotor stack and are further electrically connected to one of the coils. The IGBTs are also in electrical contact with an electrically powered bearing of the pump. Upon receiving an optical drive signal, each IGBT opens for a duration and magnitude associated with the drive signal to provide individual drive signals to the individual coils. In further arrangement, the pump utilizes one or more position sensors to identify the location of each coil in order to provide individual drive signals to those coils.

In any aspect, the pump may be configured to allow for the replacement of bearings without removing the pump from, for example, a vacuum chamber. The pump may also be constructed of materials that allow for extended use in high temperature environments.

DETAILED DESCRIPTION

Reference will now be made to the accompanying drawings, which at least assist in illustrating the various pertinent features of the presented inventions. The following description is presented for purposes of illustration and description and is not intended to limit the inventions to the forms disclosed herein. Consequently, variations and modifications commensurate with the following teachings, and skill and knowledge of the relevant art, are within the scope of the presented inventions. The embodiments described herein are further intended to explain the best modes known of practicing the inventions and to enable others skilled in the art to utilize the inventions in such, or other embodiments and with various modifications required by the particular application(s) or use(s) of the presented inventions.

Figure 1A:
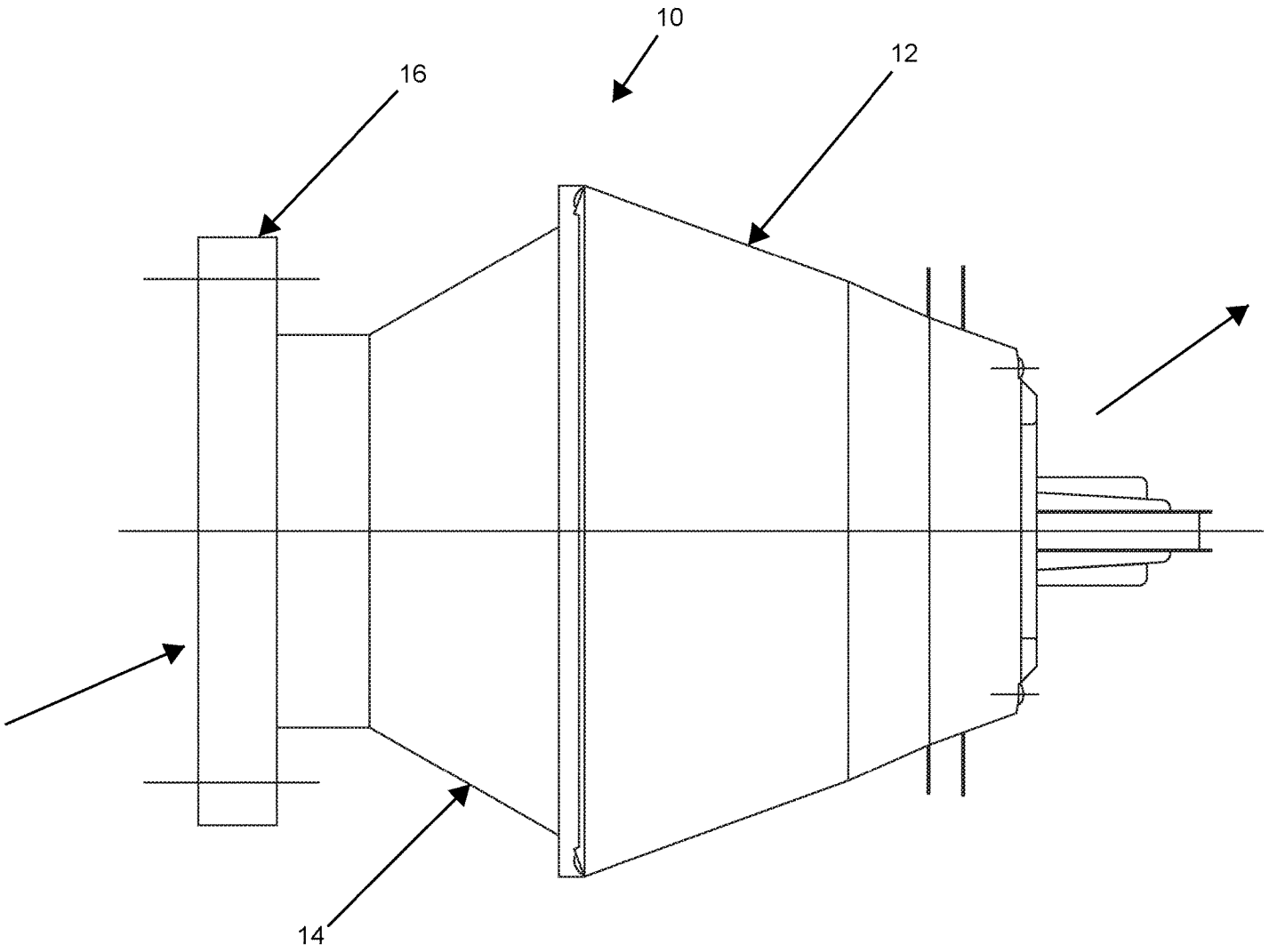
FIG. 1A illustrates a side view of a turbomolecular pump.
Figure 1B:
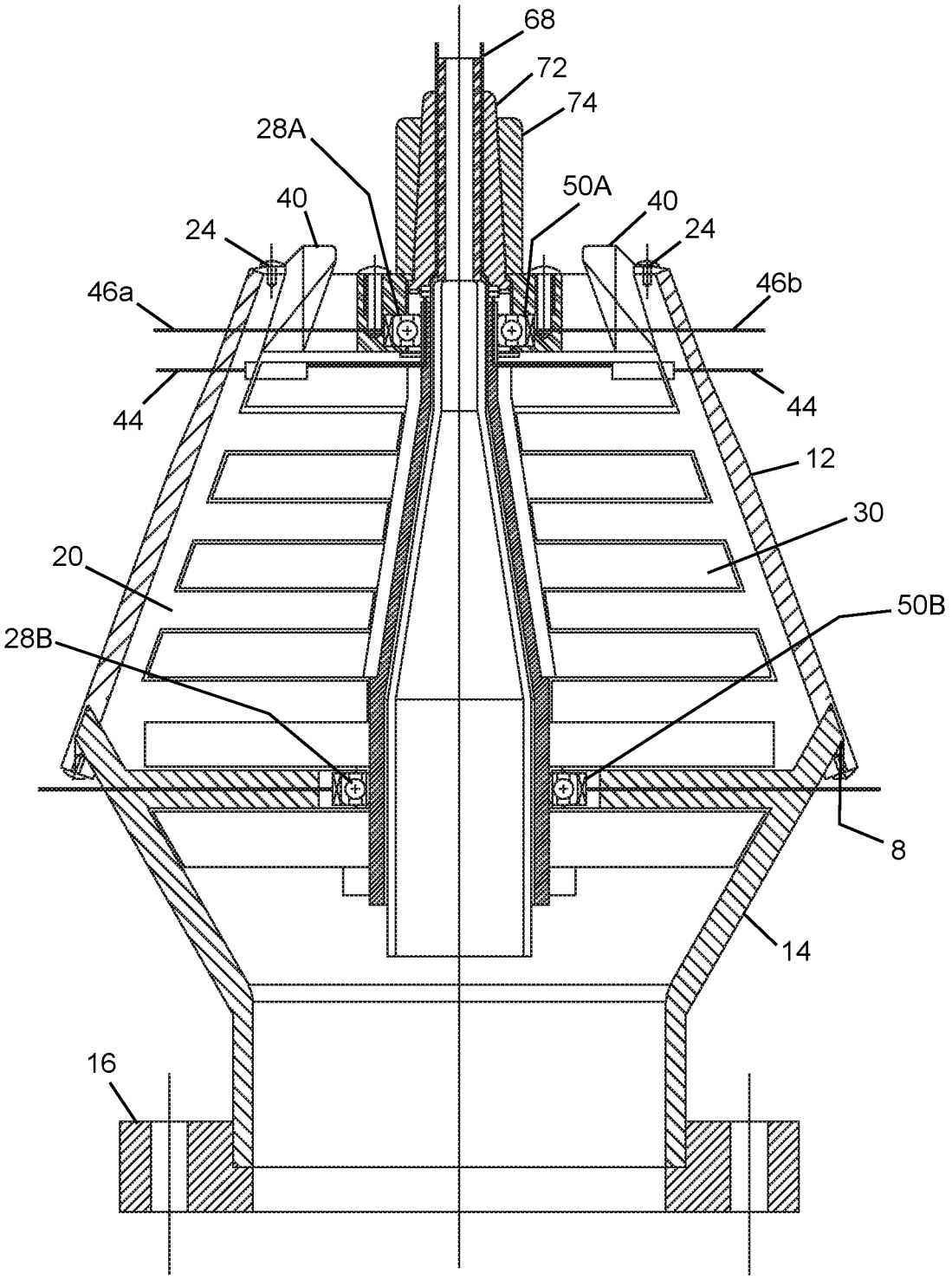
FIG. 1B illustrates a cross-sectional view of FIG. 1A.
Figure 1C:
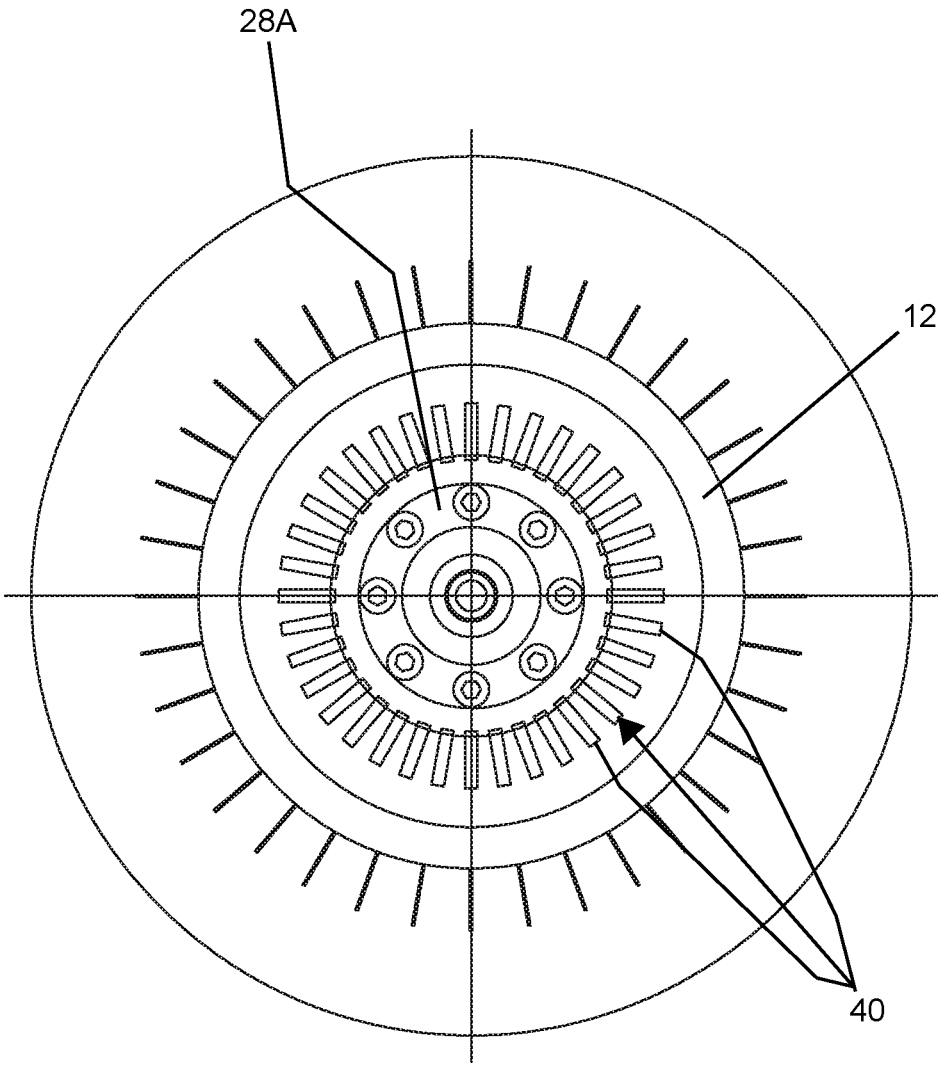
FIG. 1C illustrates a top view of the pump of FIG. 1A.

FIGS. 1A, 1B and 1C illustrate a side view, cross-sectional view and top view of a turbomolecular pump 10 (hereafter pump), respectively. The pump 10 is designed to obtain and maintain high vacuum, for instance, within vacuum chambers utilized for physical vapor deposition (PVD) processes. However, the pump is not limited to such applications. As with all turbomolecular pumps, the pump 10 has a design similar to that of the turbine. In this regard, a stack of spaced rotors, each having multiple angled/twisted blades/vanes, rotate at high-speeds between a stack of spaced and stationary stators, each having multiple angles blades/vanes. Gas molecules randomly entering the mechanism and colliding with the underside of the spinning rotor vanes are given upward momentum towards the exhaust of the pump. The present pump 10 has a number of unique features, which may be implemented alone and/or in combination. A first unique feature is provided by the conical shape of the pump 10. As further described herein, this conical shape allows for adjusting the clearance between the rotor vanes and stator vanes of the pump to provide adjustable compression ratios and/or to adjust clearance upon condensation or build-up of, for example PVD materials, on the rotor and/or stator vanes. Another unique feature is the actuator mechanism of the pump 10. In this feature, the actuator for the pump is formed from coils attached to the upper set of rotor vanes which are controlled to interact with a plurality of stationary magnets attached to the housing of the pump. In this feature, the rotor stack forms a portion (e.g., electromagnetic stator) of a drive motor for the pump. A further unique feature of the pump is the ability to dynamically balance the pump during operation. These and additional unique features are further discussed herein.

Figure 2A:
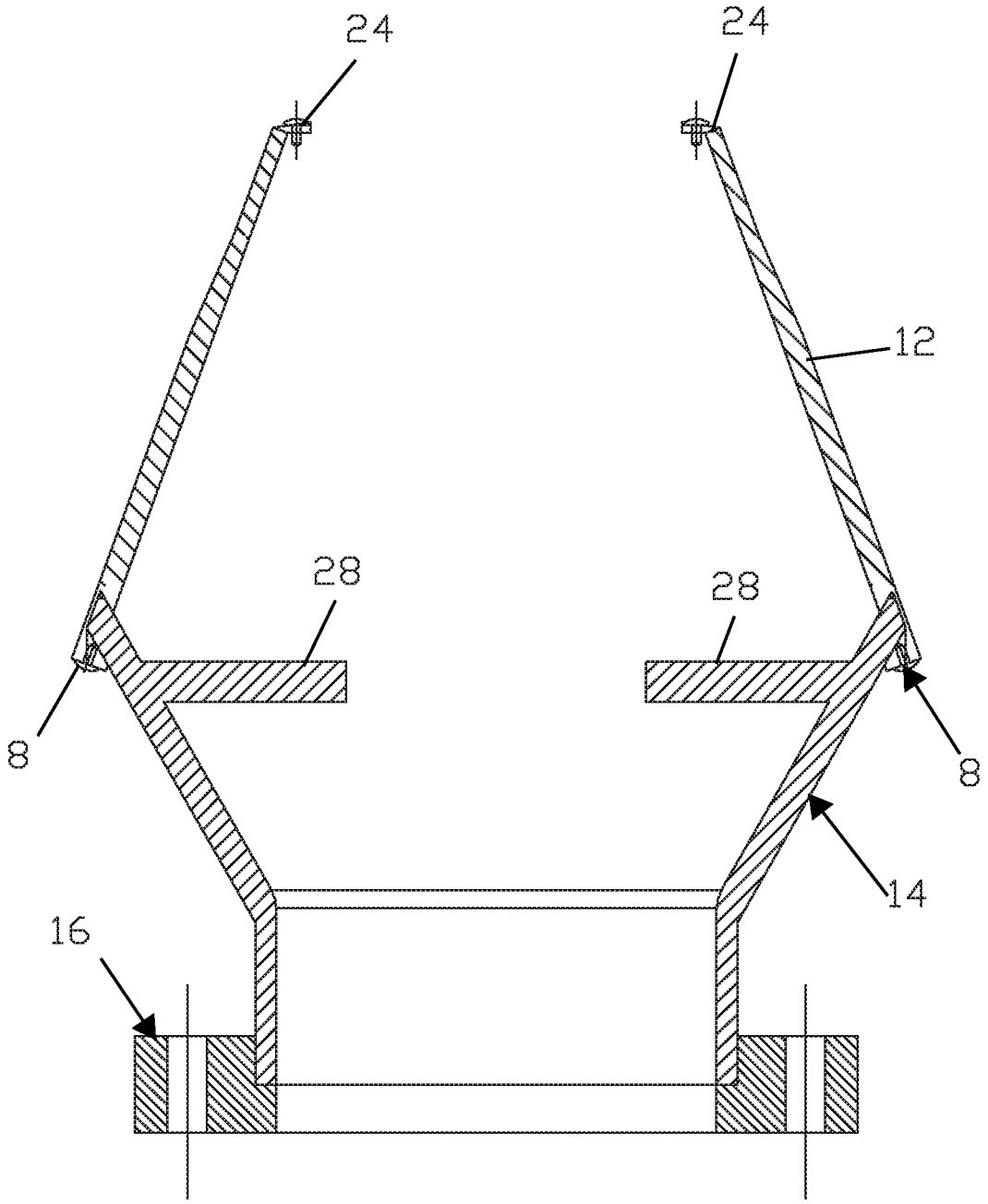
FIG. 2A illustrates a cross-sectional view of a housing of the pump.
Figure 2B:
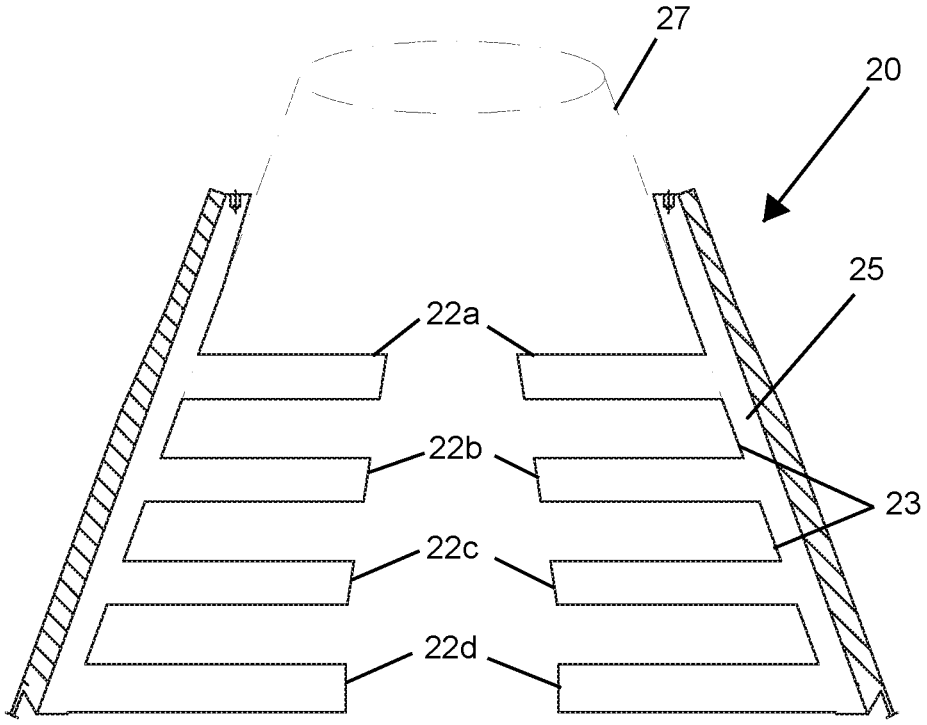
FIG. 2B illustrates a cross-sectional view of a stator stack of the pump.
Figure 2C:
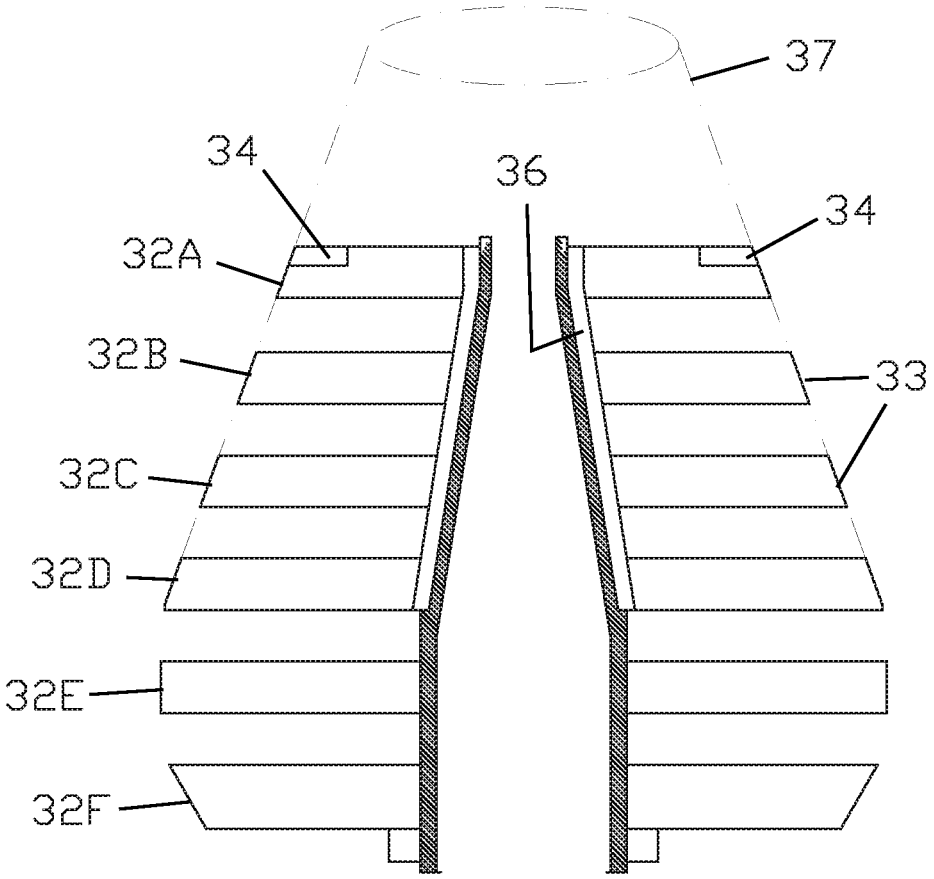
FIG. 2C illustrates a cross-sectional view of a rotor stack of the pump.

As shown in FIGS. 1A-1C, the pump 10 includes a conical housing 12 which releasably attaches to a lower pump housing or base 14, which includes a flange 16 for connection to, for example, a vacuum chamber. In operation, gasses enter into the pump 10 through the flange 16 and exit through the top end of the housing 12. As previously noted, the pump 10 operates in a manner similar to that of a turbine. In this regard, the housing 12 houses a stator stack 20 and a rotor stack 30. Cross-sectional views of the housing 12, stator stack 20 and rotor stack 30 are illustrated in FIGS. 2A, 2B and 2C, respectively. When assembled, as shown in FIG. 1B, the stator stack 20 is disposed within the interior of the housing 12 and the rotor 30 is disposed within the interior of the stator 20. More particularly, the stator stack 20 includes a plurality of sets or stages of spaced stator vanes 22A-22D (hereafter 22 unless specifically referenced) and the rotor stack 30 includes a plurality of sets or stages of spaced rotor vanes 32A-32E (hereafter 32 unless specifically referenced). As shown, upon assembly, each adjacent pair of stator vane sets (e.g., 32A, 32B) is separated by an intervening rotor vane set (e.g., 22A). In operation, the rotor stack 30 rotates about a rotor shaft 26 which is fixedly connected to the housing base 14 by two or more support structures 28 radially disposed about the rotor shaft 26. In this regard, the rotor stack 30 is rotatably coupled to the rotor shaft 26. More specifically, a hollow interior of the rotator shaft passes over an exterior of the rotor shaft 26. Upper and lower bearing assemblies 28A, 28B rotatably couple the rotor stack 30 to the rotor shaft 26. When so coupled, the rotor stack 30 is free to rotate within the interior of the pump 10. When the rotor stack 30 is driven (i.e., rotated) the rotor vane sets 32 rotate between the spaced stator vane set 22. As noted above, as gas molecules enter through the inlet of the flange, the rotor vanes 32 contact the molecules transferring mechanically energy to the molecules. This energy/momentum propels the molecules through the stator vanes where they contact the next rotor vanes or exit the pump.

Adjustable Stator Stack

As noted above, one unique feature of the pump 10 is the ability to adjust the stator stack 20 relative to the rotor stack 30 to adjust the clearance between the stator vanes and the rotor vanes. The conical or frustum shape allows the stator vanes to effectively move in two directions relative to the rotor vanes to adjust the clearances there between. Adjusting the clearance between the stator vanes and the rotor vanes allows for adjusting the compression of the pump 10 as well as adjusting clearance to account for build up or condensation of PVD materials on the rotor vanes.

As shown in FIGS. 1B and 2A-2C, the housing 12, stator stack 20 and rotor stack 30 each have a matching profile. More particularly, each of these elements has a matching conical or frustum configuration in cross-section. As shown in the cross-sectional view of FIG. 2B, inside surface of a housing 25 of the stator stack 20 (e.g., root surfaces 23 between each set of stators 22, defines a generally conical shape (e.g., first conical shape 27). As shown in the cross sectional view of FIG. 2C, the tips 33 of the rotors 32 likewise define a generally conical shape (e.g., second conical shape 37). The matching conical configuration of the stator stack and rotor stack allow the stator stack 20 to be disposed within the interior of the housing 12 while the rotor stack is disposed within the stator stack. Additionally, this conical configuration allows for adjusting the stator up and down to provide different clearances between the stator vane set 22 and rotor vane set 32. As shown in FIG. 1B and FIG. 2A, the housing has connectors or adjusters 24 (e.g., threaded elements) disposed about its periphery that engage the top edge of the stator stack 20. These adjusters 24 allow for fine up and down movement of the stator stack 20 relatively to the housing 12. In addition, such movement of the stator stack 20 adjusts the position of the stator vanes 22 relative to the rotor vanes 32 as best illustrated in FIGS. 3A and 3B.

Figure 3A:
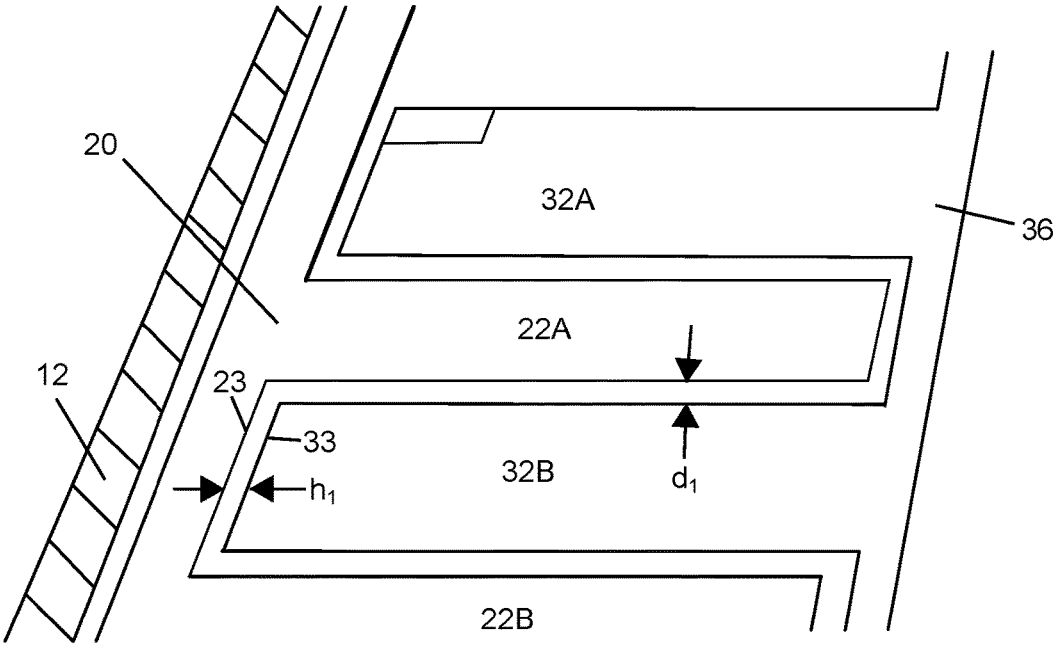
FIGS. 3A and 3B illustrate adjustment of the stator stack relative to the rotor stack.
Figure 3B:
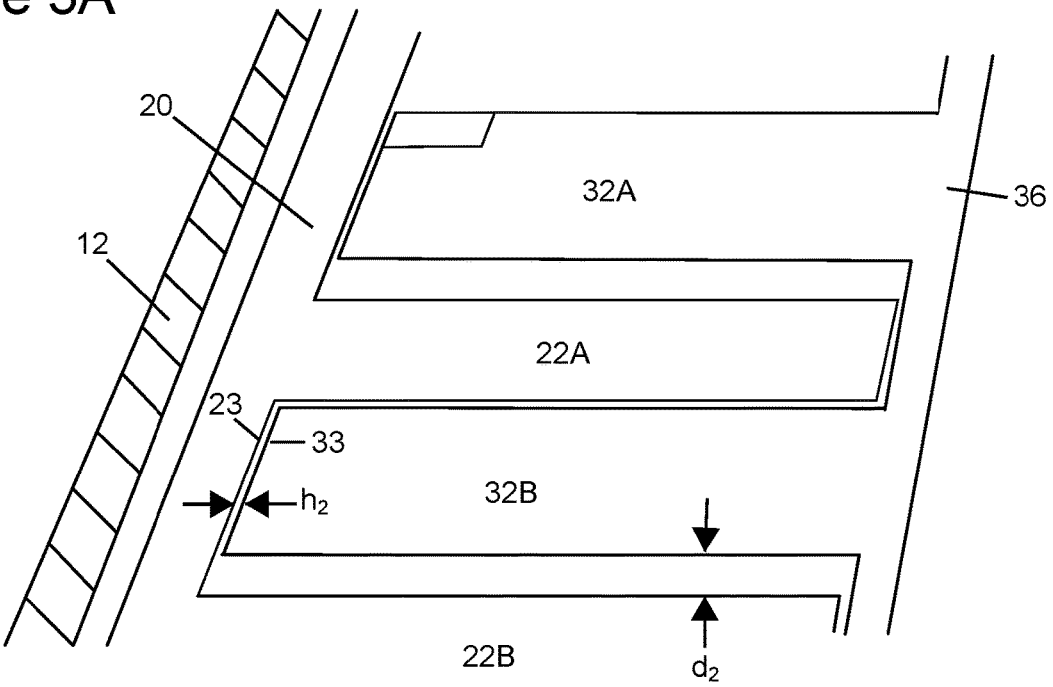

As shown FIG. 3A, the stator stack 20 is disposed in an initial position relative to the housing 12 and rotor stack 30. In this initial position, a first space or distance d1 exists between a bottom edge of an individual stator vane 22A and a top edge of an adjacent individual rotor vane 32B. Likewise a first horizontal distance h1 exist between the tip 33 of the first rotor vane 32B and the root surface 23 between two adjacent stator vanes 22A, 22B. By adjusting the adjuster 24 to lower the stator stack 20, the horizontal distance between the rotor vane 32B and the stator vane 22A may be decreased to a distance d2. Likewise the horizontal distance between the tip 33 of the stator vane 32B and the root surface 23 between the rotor vanes 22A, 22B may be decreased to a distance h2. In this regard, clearances between the stator vanes and rotor vanes may be adjusted in two directions utilizing a single downward adjustment of the stator stack 20 relative to the housing 12. As will be appreciated, such adjustment may be submillimeter adjustment. Further, it will be appreciated, in additional embodiments, that the adjusters 24 may be electronic actuators that allow for automated controlled adjustment of the stator stack 20 relative to the housing 12 and rotor stack 30. In further arrangement, the stator stack 20 may be made of multiple independent sections (not shown) and each section may be individually adjustable. In any embodiment, adjustment of the stator stack 20 allows for adjusting the clearances between the stators vanes 22 and the rotor vanes 32 to adjust the compression ratio of the pump and/or to provide necessary clearance due to deposition of matter on the stators and/or rotors.

Stator Vane Drive

As noted above, a unique feature of the presently disclosed pump is that the rotor stack 30 forms a portion of the actuator mechanism for the pump 10. Previously, turbo pumps have utilized a separate electric motor to rotate the rotor stack of the pump. In the present pump 10, the actuator for the pump is formed from coils attached to the upper set of rotor vanes which are controlled to interact with a plurality of stationary magnets attached to the housing of the pump. In this feature, the rotor stack in addition to providing compression and movement of gas molecules also forms an electromagnetic stator of a drive motor for the pump.

Figure 4A:
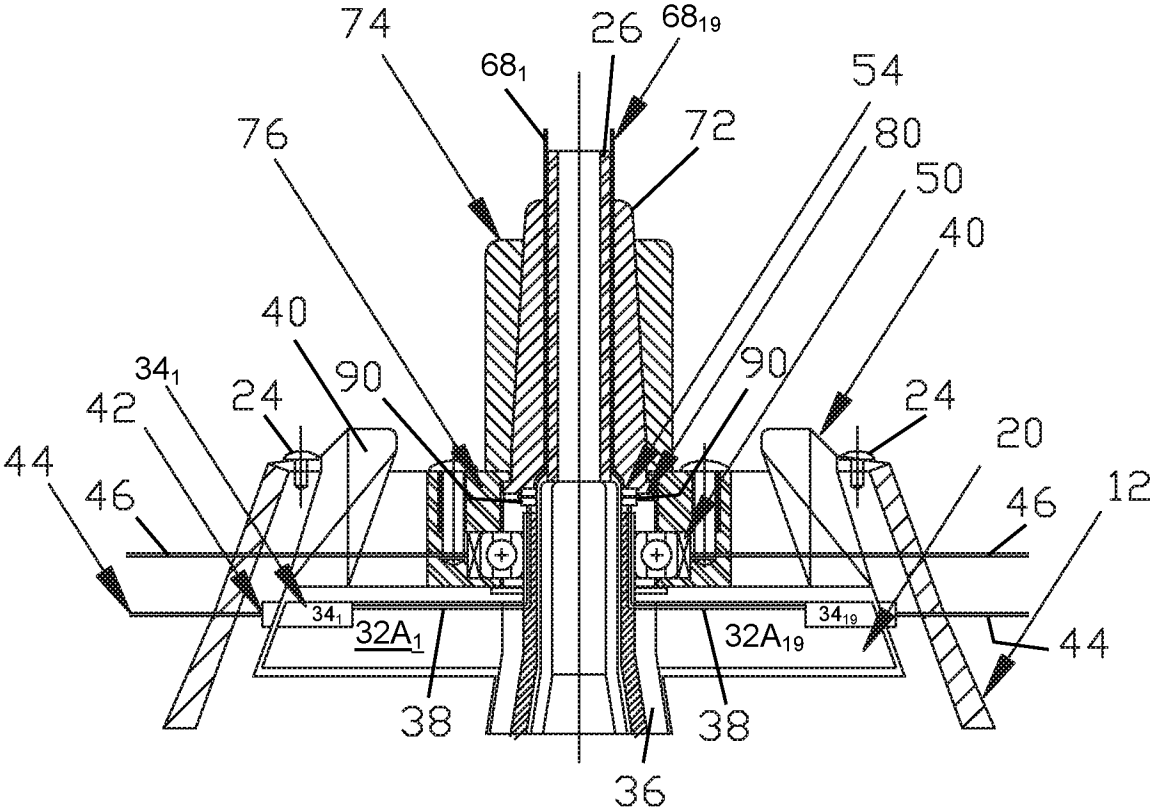
FIG. 4A illustrates a cross-sectional view of a rotor drive mechanism for the pump.
Figure 4B:
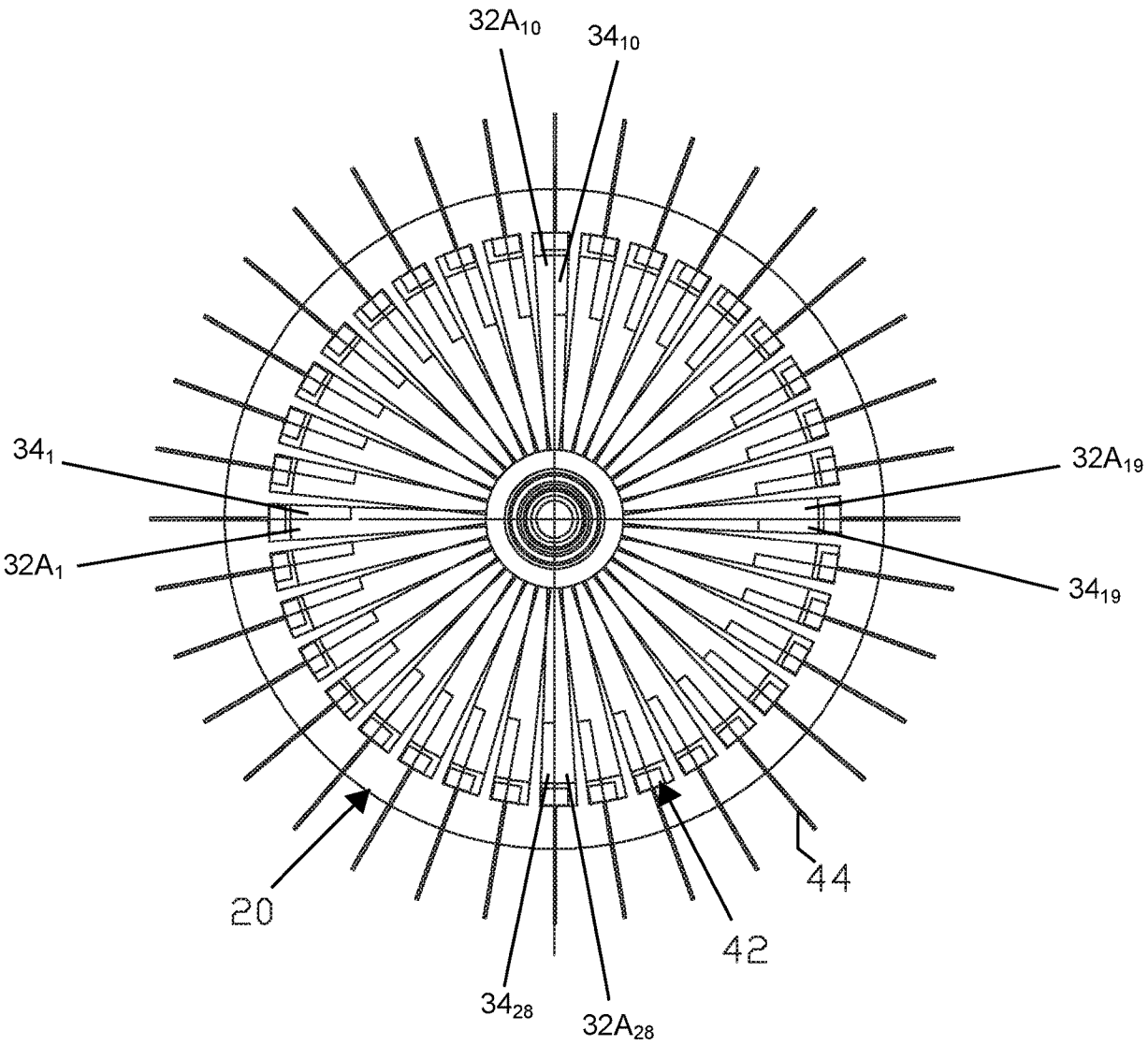
FIG. 4B illustrates a top view of the rotor stack.

As best shown in FIGS. 1C, 2C, 4A and 4B, the uppermost set of rotor vanes 32A each include an electromagnetic coil or rotation coil 34. As Shown in FIG. 4B, the uppermost set of rotor vanes 32A, is formed of a plurality of individual rotor blades or vanes $\mathbf{32}A_{1\text{-}36}$ (hereafter stator vane 32A unless specifically referenced) radially disposed around a hub 36 of the rotor stack 30. Though illustrated as utilizing thirty-six individual vanes 32 per row or set in the rotor stack 30, it will be appreciated that the number of vanes is by way of example and not by way of limitation. Along these lines, the rotor stack may include more or fewer vanes in each row/set. Likewise, the number of vanes may vary between different rows of the rotor stack. Though not illustrated, it will be appreciated that each row of stator vanes may have a similar configuration, though the individual stator vanes would extend radially inward from an outer housing of the stator stack. As shown, each stator vane 32 includes a rotational coil 34 (e.g., coils $\mathbf{34}_{1\text{-}36}$) disposed proximate to its tip. Each coil 34 is electrically connected to a power source (which is more fully discussed herein) by electrical connectors 38 that extend along or within a surface of the vane 32 between coil 34 and the rotor hub 36.

The coils 34 are selectively actuated to impart rotation to the rotor stack 30. More specifically, plurality of coils 34 attached to the plurality of rotor vanes 32A interact with a corresponding plurality of permanent magnets 40, which are fixedly attached to the housing 12. See FIGS. 1C and 4A. Current from the power source flows through the electrical connectors and coils 34, making it a temporary magnet (an electromagnet). The magnetic field produced by the coils interacts with an adjacent stationary magnetic field produced by the permanent magnets 40 attached to the housing. The force between the two magnetic fields rotates rotor stack 30. A control system of the pump switches power to the coils 34 as the rotor stack 30 turns, keeping the magnetic poles of the rotor coils 34 from ever fully aligning with the magnetic poles of the permanent magnets 40, so that the rotor stack 30 never stops rotating, but rather keeps rotating as long as power is applied.

In order to control the rotation of the rotor stack, a control system of the pump 10 must know the angular orientation of the rotor blades 32A and their supported coils 34. In the present embodiment, a plurality of optical sensors 42 are disposed radially around the outer periphery of the first row/set of rotor blades 32A. In the illustrated embodiment, each of these optical sensors 42 is disposed within a recess in a casing of the stator stack 20. Further, in the present embodiment, each optical sensor 42 is connected to the control system of the pump via a fiber optic filament 44. In operation, the optical sensors 42 output information that is utilized by the control system to determine the orientation of an adjacent stator vane 32 such the control system may controllably operate the coils 34 to control the rotation of the rotor stack 30.

The present embodiment utilizes fiber optic filaments 44 to connect the optical sensors to the control system. Other embodiments may utilize non-optical sensors to provide such sensing and may utilize different connections. However, the utilization of fiber optic sensors and fiber optic filaments provides a benefit for the presented pump. Particularly, the pump 10 is often utilized in PVD processes where ionized matter and/or plasma fields exist. Such ionized matter in plasma fields often result in considerable electronic noise. Additional electronic noise is generated by the high speed operation of the pump itself. Along these lines, the use of optical sensors and optical signal transmission significantly reduces or eliminates potential interference that may arise from electronic noise.

Dynamic Balancing

As noted above, another feature of the pump is the ability to dynamically balance the pump during operation. During a PVD process, which generates chemical vapors or metals, turbo pump vanes can be subject to condensation of any process materials which can create an unbalanced condition for the turbo pump rotor. To minimize the vapor deposition on the vanes, turbo pumps are often externally heated. However, heating of turbo pumps is time-limited in extreme conditions (e.g., high temperatures). Such high temperature operation can result in premature bearing failure. The presented turbo pump 10 provides a mechanism for dynamically balancing the rotor during operation to offset imbalances that may occur due to condensation of process materials on the rotor vanes. More specifically, the use of the stator vane drive, described above, allows applying the non-uniform drive forces to the rotor stack, which can counteract imbalances that occur during operation.

Figure 5:
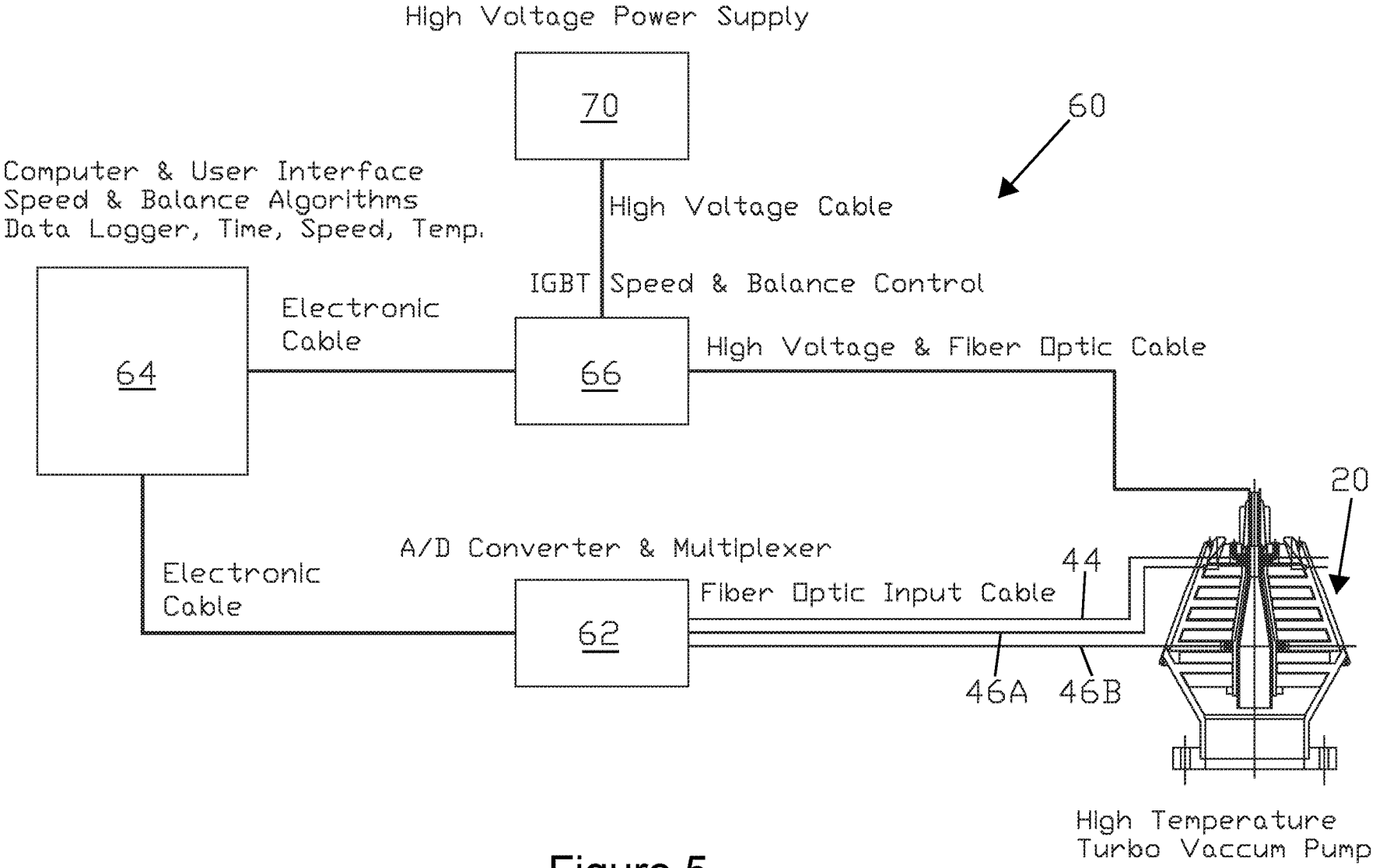
FIG. 5 illustrates a diagram of a control system of the pump.

FIG. 5 illustrates the turbo pump 10 and an exemplary control system 60 that is operative to identify imbalances in the rotor stack of the turbo pump 10 and controllably drive each coil 34 on the first set of rotor vanes to counter act such imbalances. As shown, the control system 60 receives optical outputs from the optical position sensors 42 via the optical filaments 44 as well as outputs from optical strain force sensors associated with the upper and lower bearing assemblies 28A, 28B, which rotatably couple the rotor stack to the rotor shaft. The control system 60 receives the outputs from the optical strain sensors 50 via fiber optic filament bundles 46A, 46B, which are connected to the optical strain sensors 50, as is more fully discussed herein. The optical output signals are received by an A/D converter and multiplexer 62, which generates corresponding electronic outputs, which are provided to a processing system 64. The processing system 64 may include various processors, data storage devices and/or user interfaces. The processing system 64 includes speed and balance algorithms that allow the control system 60 to determine any imbalances present in the rotor stack 30. Based on the outputs of the strain sensors 50, the processing system 64 generates individual coil activation signals for each coil 34 associated with each individual rotor vane 32. In this regard, different individual vanes 32 may experience different drive forces which may be utilized to counteract imbalances in the rotor stack. In the present embodiment, the individual outputs generated by the processor are provided to a D/A converter and further converted into optical signals which are provided to each individual coil 34 by an optical filament bundle 68. The optical filament bundle 68 includes individual fiber optic filaments that communicate with each individual coil. This operation is more fully discussed herein.

Figure 6:
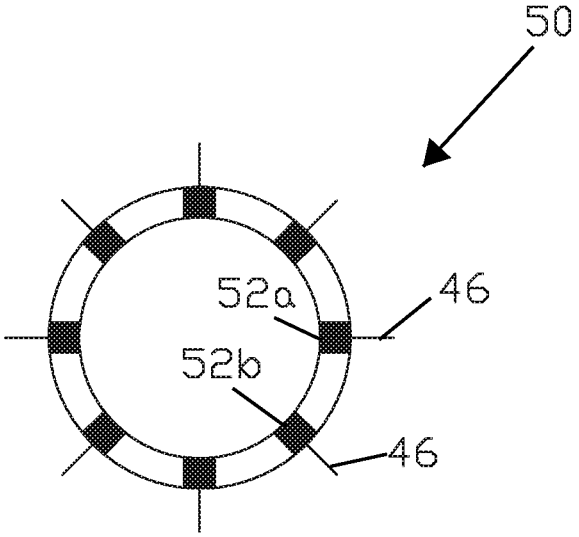
FIG. 6 illustrates an optical strain sensor of the pump.

As previously noted, the rotor stack 30 is rotatably coupled to the rotor shaft 26 by upper and lower bearing assemblies 28A, 28B. Each of these bearing assemblies 28A, 28B further incorporates an optical strain sensor 50A, 50B, respectively. These optical strains sensors 50A, 50B (hereafter 50 unless specifically referenced) are annular elements that surround their respective bearing assembly and which are connected to the control system by their respective optical filament sets 46A or 46B. FIG. 6 illustrates one embodiment of an optical strain force sensor. As shown, the sensor 50 is an annular element having multiple individual optical sensor elements 52A-N (hereafter 52 unless specifically referenced) radially disposed about the periphery of the sensor 50. Of note, the exemplary sensor 50 illustrates the use of eight individual optical sensor elements. However, it will be appreciated that this illustration is for purposes of discussion only. Along these lines, the sensor 50 may incorporate a number of optical sensors equal to the number of vanes in the rotor stack. However, this is not a requirement. As shown, each optical sensor 52 is interconnected an individual optical filament 46 which provides optical signals to and from the optical sensor 52. In the present embodiment, the optical sensor elements 52 are formed of birefringence elements. As known to those skilled in the art, birefringence elements are optically anisotropic materials that are birefractive. Optical signals passing through or reflected through the birefringent element with an axis not aligned to the optical axis of the element and is split by polarization into two rays taking slightly different paths. When strain forces are absent, an optical signal provided to the element may pass or reflect as a single ray. When strain forces are present, the birefringent element is slightly deformed. Thus, an optical signal passing though or reflected by the birefringent element may be split into two rays. The distance between the rays can be measured to determine an amount of strain present in the birefringence element 52. The processor 64 of the control system 60 is operative to utilize all of the outputs from the upper and lower optical strain sensors 50A, 50B to determine where strain is present in the bearings. That is, the processor determines where strain is present in the bearing at a single point in time while the rotor is rotating. From this information, the processor determines where an imbalance is present in the rotor stack. Of note, this imbalance will continually rotate as the imbalanced rotor stack rotates. Though the rotor stack rotates at high speed, the speed of the computing system is sufficient to identify the strains and imbalance at discrete times such that the radial location of the imbalance of the rotor stack may be identified. In this regard, the outputs of the position sensors may also be utilized by the processor to identify, for example, a radial location on the stator stack where an imbalance is present.

Figure 7A:
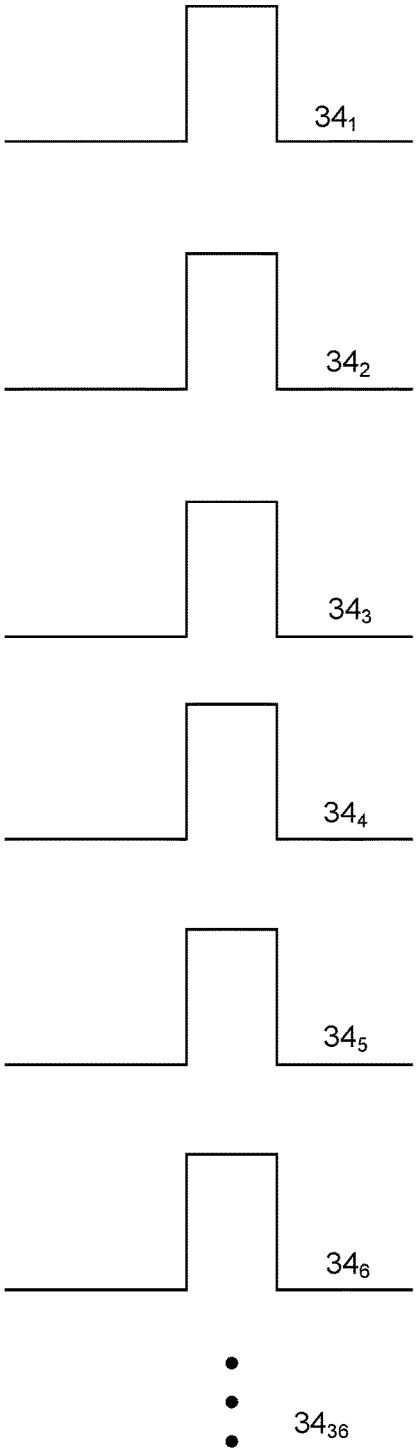
FIGS. 7A and 7B illustrate drive signals for the pump.
Figure 7B:
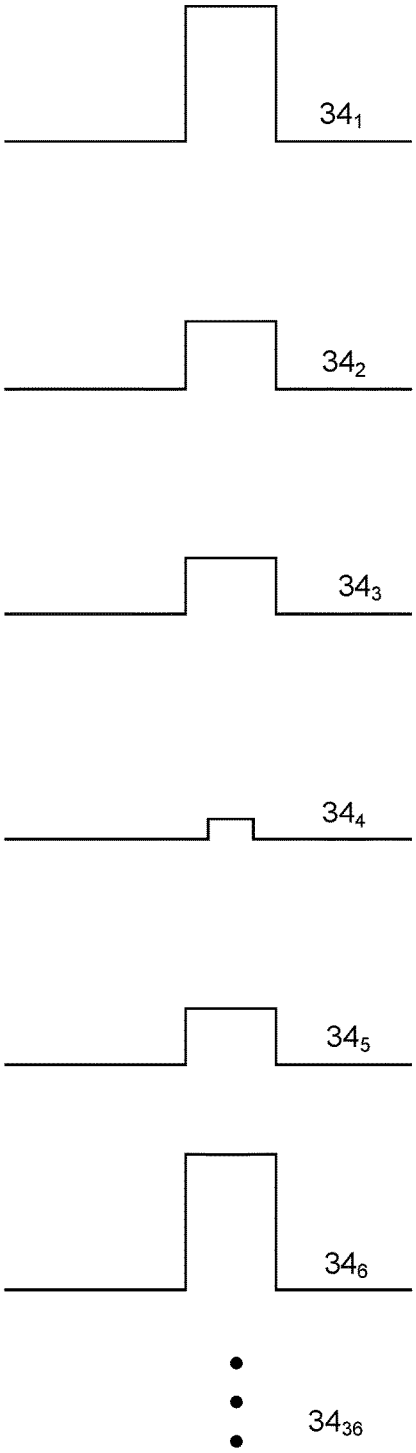

To counteract the effects of an imbalance in the rotor stack 30, the processor 64 generates individual drive signals (e.g., drive pulses) for each of the coils 34 attached to each of the rotor blades 32A. That is, in the illustrated embodiment, the processor 64 generates thirty-six individual drive signals for each of the coils $\mathbf{34}_{1\text{-}36}$ attached to each of the thirty-six individual stator vanes $\mathbf{32}A_{1\text{-}36}$, respectively. FIG. 7A illustrates drive signals that may be applied to each of the individual coils 34 in a situation where the rotor stack 30 is balanced. In such a situation, each drive signal applied to each coil 34 may be uniform in magnitude and duration. That is, the processor may provide uniform drive signals such that each coil is activated equally providing equal rotational forces around the rotor stack. FIG. 7B illustrates a situation where an imbalance is identified within the rotor stack based on the outputs of the optical strain sensors. In such a situation, the processor may generate drive signals having different magnitudes and/or durations to counter effect an imbalance in the rotor stack. For instance, as shown in FIG. 7B, the duration and magnitude of the coil 344 attached to rotor vane $\mathbf{32}A_4$ may be reduced in magnitude and duration to offset an imbalance in the rotor stack. Further, it will be appreciated that individual coils may be deactivated to counteract imbalances in the rotor stack. In the present embodiment, the drive signals are provided to each of the individual coils via individual fiber optic filaments of the fiber-optic bundle 68.

A system for applying individual signals to individual coils 34 of the rotating rotor stack and powering each of the individual coils 34 is further illustrated in FIG. 4A. In the present embodiment, an upper portion of the stationary shaft 26 of the pump 10 is surrounded by a high voltage pulsed conductor 72, which is connected to the power source 70 (see FIG. 5). The pulsed conductor provides power which is distributed to the coils 34 in accordance with the drive signals provided by the processor 64. As shown, an upper portion of the conductor 72 is surrounded by a high voltage insulator 74 and a lower portion of the conductor is secured by a bearing insulator 76. A bottom end of the conductor is in direct connection with a fluid metal seal 80. The fluid metal seal 80 also provides an electrical connection that connects the power source 70 to the coils as discussed below. Stated otherwise, the pulsed conductor electrifies the fluid metal seal, which could also be termed as a fluid rotational electrical conductor. The seal 80 provides a seal across the pump (e.g., from vacuum to ambient pressure) while permitting rotation of the rotor stack 30. Such fluid or liquid metal seals are known in the art. See, for example, U.S. Pat. No. 5,799,951, which is incorporated herein by reference.

In order to provide individual drive signals to individual coils, individual filaments $\mathbf{68}_{1\ and\ 19}$ (only two shown) of the filament bundle 68 enter the pump 10 alongside the stationary rotor shaft 26. These filaments 68 each terminate at a fiber optic actuator 54, which is disposed adjacent to an optically actuated insulated-gate bipolar transistor (IGBT) 90. The IGBT is in electrical connection with the electrified seal 80. Upon a filament (e.g., filament $\mathbf{68}_{19}$) providing an optical signal (e.g., drive signal) to the optical actuator 54, the optical actuator 54 outputs a light pulse corresponding to the drive signal to the optical IGBT 90. The IGBT 90 opens for a duration and magnitude corresponding to the drive signal provided by the processor via the filament $\mathbf{68}_{19}$. That is, the IGBT passes electrical power to the coil $\mathbf{34}_{19}$ via the electrical connector 38. The power is provided to the coil $\mathbf{34}_{19}$ with a corresponding duration and magnitude to the drive signal provided for that coil. The energized coil interacts with an adjacent permanent magnet 40 as described above to rotate the rotor stack.

As may be appreciated, each individual coil 34 is connected to an individual IGBT 90 via an individual connector 38. Along these lines, the IBGTs are connected to the hub 36 of the rotor stack and rotate with the rotor stack. In this regard, the drive signals provided to the IGBTs by the optical actuators 50 must be provided when the optical IGBT is aligned with the optical actuator 50. This information is known by the processor via the optical position sensors 42. Again, due to the processing speeds of modern computers, delivery of the drive signals to individual coils is possible even at high rotational speeds.

Though a number of features have been discussed, the pump 10 includes a number of additional features that are novel alone and/or in various combination with the features discussed above. For example, the pump is configured to facilitate field maintenance. As best show in FIG. 1B, the upper housing 12 is connected to the base housing 14 via a plurality of base fasteners 8. Removal of these base fasteners allows for the removal of the upper housing 12, which provides access to the upper and lower bearing assemblies 28A, 28B. Upon loosening the bearing fasteners, the rotor stack 30 and stator stack 20 may be removed from the rotor shaft. This allows for replacement of the bearings without removing the remainder of the pump (e.g., flange 16) from a vacuum chamber. Likewise, the rotor stack and/or stator stack may be replaced.

The foregoing description has been presented for purposes of illustration and description. Furthermore, the description is not intended to limit the inventions and/or aspects of the inventions to the forms disclosed herein. Consequently, variations and modifications commensurate with the above teachings, and skill and knowledge of the relevant art, are within the scope of the presented inventions. The embodiments described hereinabove are further intended to explain best modes known of practicing the inventions and to enable others skilled in the art to utilize the inventions in such, or other embodiments and with various modifications required by the particular application(s) or use(s) of the presented inventions. It is intended that the appended claims be construed to include alternative embodiments to the extent permitted by the prior art.

What is claimed is:

1. A turbomolecular pump comprising:

a plurality of spaced rotor sets defining a rotor stack, each rotor set having a plurality of blades radially extending from a rotating hub, wherein, in cross-sectional profile, tip surfaces of the rotor stack define a first conical surface;

a plurality of spaced stator sets defining a stator stack, where the spaced stator sets are arranged alternately with the rotor sets, each stator set having a plurality of blades radially extending toward the rotating hub from an outer stator housing, wherein, in cross-sectional profile, root surfaces of the stator housing between the stator sets define a second conical surface;

a pump housing disposed around the outer stator housing and connected to a rotor shaft that is rotatively coupled to the rotor stack, wherein the rotor shaft defines a vertical axis of the pump;

at least a first adjustable connector connecting the stator stack to the pump housing, wherein adjustment of the adjustable connector adjusts a position of the rotor stack along the vertical axis, wherein an axial position of the second conical surface is moved relative to the first conical surface.

2. The pump of claim 1, wherein adjustment of the adjustable connector adjusts a distance between the tip surfaces of the rotor stack and root surfaces of the stator housing.

3. The pump of claim 2, wherein adjustment of the adjustable connector adjusts a distance between bottom edges of the blades of the stator stack and a top edges of the rotor stack.

4. The pump of claim 1, further comprising:

a plurality of coils attached to the plurality of blades of one set of the rotor stack; and a plurality of magnets fixedly attached to the pump housing; and a control system configured to provide a plurality of individual drive signals to each of the plurality of coils, wherein the plurality of coils are electrified in response to the drive signals and interact with the magnets to rotate the rotor stack.

5. The pump of claim 4, further comprising:

strain sensors radially disposed about a bearing that couples the rotor stack to the rotor shaft, wherein outputs of the strain sensors are output to the control system.

6. The pump of claim 5, wherein the control system is configured to utilize the outputs of the strain sensor to identify an imbalance in the rotor stack during rotation.

7. The pump of claim 6, wherein the control system alters one or more of the plurality of individual drive signals to counteract the imbalance.

8. The pump of claim 5, wherein said stain sensors comprise optical strain sensors and wherein outputs of the optical strain sensors are provided to the control system via optical connections.

9. A turbomolecular pump comprising:

a plurality of spaced rotor sets defining a rotor stack, each rotor set having a plurality of blades radially extending from a rotating hub;

a plurality of spaced stator sets defining a stator stack, where the spaced stator sets are arranged alternately with the rotor sets, each stator set having a plurality of blades radially extending toward the rotating hub from an outer stator housing;

a pump housing disposed around the outer stator housing and connected to a rotor shaft that is rotatively coupled to the rotor stack by at least a first bearing;

a plurality of coils attached to the plurality of blades of one set of the rotor stack; and a plurality of magnets fixedly attached to the pump housing; and a control system configured to provide a plurality of individual drive signals to each of the plurality of coils, wherein the plurality of coils are electrified in response to the drive signals and interact with the magnets to rotate the rotor stack.

10. The pump of claim 9, further comprising:

strain sensors radially disposed about the at least one bearing that couples the rotor stack to the rotor shaft, wherein outputs of the strain sensors are output to the control system.

11. The pump of claim 10, wherein the control system is configured to:

utilize the outputs of the strain sensor to identify an imbalance in the rotor stack during rotation; and alter one or more of the plurality of individual drive signals to counteract the imbalance.

12. The pump of claim 10, wherein said stain sensors comprise optical strain sensors and wherein outputs of the optical strain sensors are provided to the control system via optical connections.

13. The pump of claim 9, further comprising a plurality of optically actuated insulated-gate bipolar transistors (IGBTs) connected to the rotor stack, wherein each IGBT is electrically connected to one of the coils.

14. The pump of claim 13, wherein each IGBT is electrically coupled to a metal bearing associated with the rotor shaft, wherein the metal bearing is connected to a power source.

15. The pump of claim 14, further comprising:

a plurality of optical actuators connected to the rotor shaft, wherein the optical actuators are disposed adjacent to the IGBTs of the rotor stack and are connected to the control system via optical connections.

16. The pump of claim 15, wherein each optical actuator is configured to receive the drive signals from the control system via and generate an optical output in response to a received drive signal.

17. The pump of claim 16, wherein the optical output of each optical actuator is received by one IGBT, wherein the IGBT opens for a duration an magnitude corresponding to the drive signal, wherein power from the bearing is provided to a coil associated with the IGBT.

18. The pump of claim 9, further comprising:

at least one position sensor configured to identify an angular orientation of the rotor stack, wherein an output of the position sensor is output to the control system.

19. The pump of claim 18, wherein the position sensor is an optical sensor mounted to the housing.

20. The pump of claim 19, wherein the position sensor is connected to the control system via an optical connection.

* * * * *